US005938425A

United States Patent [19]

Damrath et al.

[11] Patent Number: 5,938,425

[45] Date of Patent: Aug. 17, 1999

[54] METHOD AND DEVICE FOR CONTROL OF THE FLAME SIZE OF GAS-FIRED COOKING OR BAKING APPLIANCES

[75] Inventors: Joachim Damrath; Gerhard Rothenberger, both of Gaggenau; Martin Kornberger, Baden-Baden, all of Germany

[73] Assignee: Gagenau Hausgeräte GmbH, Gaggenau, Germany

[21] Appl. No.: 08/886,275

[22] Filed: Jul. 1, 1997

[30] Foreign Application Priority Data

Jul. 9, 1996 [DE] Germany ..... 196 27 539

[51] Int. Cl.[6] ..... F23N 5/00; F23N 11/44; E03B 65/20

[52] U.S. Cl. ..... 431/62; 431/37; 431/89; 431/12; 137/599.1; 137/601; 126/39 E

[58] Field of Search ..... 431/62, 63, 36, 431/37, 41, 12, 89, 29, 18; 236/15 A, 15 BR; 137/94, 599, 599.1, 601; 126/39 E, 29 N

[56] References Cited

U.S. PATENT DOCUMENTS

| | | | |
|---|---|---|---|
| 3,067,761 | 12/1962 | Absalom | 137/599 |
| 3,247,886 | 4/1966 | Mitchell | 431/29 |
| 3,905,394 | 9/1975 | Jerde | 431/12 |
| 3,908,686 | 9/1975 | Carter et al. | 137/94 |
| 4,229,157 | 10/1980 | Ito et al. | 431/12 |
| 4,425,930 | 1/1984 | Kruto | 431/62 |
| 4,478,246 | 10/1984 | Sherrod | 137/601 |
| 4,518,011 | 5/1985 | Stoll | 137/599 |
| 4,585,161 | 4/1986 | Kusama et al. . | |
| 5,653,220 | 8/1997 | Velie et al. | 126/39 N |

FOREIGN PATENT DOCUMENTS

| | | |
|---|---|---|
| 911892 | 7/1946 | France . |
| 4225789 | 2/1993 | Germany . |
| 61-159028 | 7/1986 | Japan . |
| 61-159028 | 12/1986 | Japan . |
| 8102571 | 12/1982 | Netherlands . |
| 303445 | 2/1955 | Switzerland . |

OTHER PUBLICATIONS

Patent Abstracts Of Japan, Publication No. 59147930, Publication Date Aug. 24, 1984.

*Primary Examiner*—Ira S. Lazarus
*Assistant Examiner*—Josiah C Cocks
*Attorney, Agent, or Firm*—Sprung Kramer Schaefer & Briscoe

[57] ABSTRACT

A device and a method for the controlled reduction of the gas flow Q fed to a burner nozzle of a gas-fired cooking or baking appliance via a gas supply pipe. The gas supply pipe is branched into a number n of partial gas pipes connected in parallel, through which a partial gas flow $Q_k$ with k=1,2,3, . . . ,n can be fed to the burner nozzle in each case, and which have a control unit in each case, the control units each being connected on their gas inlet side to the gas supply pipe and on their gas outlet side to the burner nozzle, and have a switching element for switching on and off the partial gas flow $Q_k$ passing through them and a throttle element for reduction of the partial gas flow $Q_k$ passing through them. The switching elements can be switched on and off according to the selected heating power. Alternatively a number n of throttle elements are connected in series with switching elements connected in parallel.

14 Claims, 6 Drawing Sheets

| | 11<br>$Q_1 = 1/16$ | 21<br>$Q_2 = 2/16$ | 31<br>$Q_3 = 4/16$ | 41<br>$Q_4 = 8/16$ |
|---|---|---|---|---|
| $S_1 = 0$ | 0 | 0 | 0 | 0 |
| $S_2 = 1/15$ | 1 | 0 | 0 | 0 |
| $S_3 = 2/15$ | 0 | 1 | 0 | 0 |
| $S_4 = 3/15$ | 1 | 1 | 0 | 0 |
| $S_5 = 4/15$ | 0 | 0 | 1 | 0 |
| $S_6 = 5/15$ | 1 | 0 | 1 | 0 |
| $S_7 = 6/15$ | 0 | 1 | 1 | 0 |
| $S_8 = 7/15$ | 1 | 1 | 1 | 0 |
| $S_9 = 8/15$ | 0 | 0 | 0 | 1 |
| $S_{10} = 9/15$ | 1 | 0 | 0 | 1 |
| $S_{11} = 10/15$ | 0 | 1 | 0 | 1 |
| $S_{12} = 11/15$ | 1 | 1 | 0 | 1 |
| $S_{13} = 12/15$ | 0 | 0 | 1 | 1 |
| $S_{14} = 13/15$ | 1 | 0 | 1 | 1 |
| $S_{15} = 14/15$ | 0 | 1 | 1 | 1 |
| $S_{16} = 15/15$ | 1 | 1 | 1 | 1 |

Fig. 2

| | 11<br>$a_1 = 1/9$ | 21<br>$a_2 = 1/9$ | 31<br>$a_3 = 2/9$ | 41<br>$a_4 = 5/9$ |
|---|---|---|---|---|
| $S_1 = 0$ | 0 | 0 | 0 | 0 |
| $S_2 = 1/9$ | 1 | 0 | 0 | 0 |
| $S_3 = 2/9$ | 0 | 0 | 1 | 0 |
| $S_4 = 3/9$ | 0 | 1 | 1 | 0 |
| $S_5 = 4/9$ | 1 | 1 | 1 | 0 |
| $S_6 = 5/9$ | 0 | 0 | 0 | 1 |
| $S_7 = 6/9$ | 0 | 1 | 0 | 1 |
| $S_8 = 7/9$ | 0 | 0 | 1 | 1 |
| $S_9 = 8/9$ | 1 | 0 | 1 | 1 |
| $S_{10} = 9/9$ | 1 | 1 | 1 | 1 |

Fig.3

| | 51<br>$a_5 = 1/18$ | 11<br>$a_1 = 1/9$ | 21<br>$a_2 = 1/9$ | 31<br>$a_3 = 2/9$ | 41<br>$a_4 = 5/9$ |
|---|---|---|---|---|---|
| $S_1 = 0$ | 0 | 0 | 0 | 0 | 0 |
| $S_2 = 1/9$ | 0 | 1 | 0 | 0 | 0 |
| $S_3 = 2/9$ | 0 | 0 | 0 | 1 | 0 |
| $S_4 = (2,5)/9$ | 1 | 0 | 0 | 1 | 0 |
| $S_5 = 3/9$ | 0 | 0 | 1 | 1 | 0 |
| $S_6 = (3,5)/9$ | 1 | 0 | 1 | 1 | 0 |
| $S_7 = 4/9$ | 0 | 1 | 1 | 1 | 0 |
| $S_8 = (4,5)/9$ | 1 | 1 | 1 | 1 | 0 |
| $S_9 = 5/9$ | 0 | 0 | 0 | 0 | 1 |
| $S_{10} = (5,5)/9$ | 1 | 0 | 0 | 0 | 1 |
| $S_{11} = 6/9$ | 0 | 0 | 1 | 0 | 1 |
| $S_{12} = 7/9$ | 0 | 0 | 0 | 1 | 1 |
| $S_{13} = 8/9$ | 0 | 1 | 0 | 1 | 1 |
| $S_{14} = 9/9$ | 0 | 1 | 1 | 1 | 1 |

Fig.4

METHOD AND DEVICE FOR CONTROL OF THE FLAME SIZE OF GAS-FIRED COOKING OR BAKING APPLIANCES

BACKGROUND OF THE INVENTION

The invention relates to a device and a corresponding method for the controlled stepwise reduction of the gas flow Q supplied to a burner nozzle of a gas-fired cooking or baking appliance via a gas supply pipe.

Conventional cooking or baking appliances, e.g. gas cookers, gas cooking ranges or gas baking ovens, have one or more burners, in which the gas is mixed with atmospheric oxygen and burnt. The gas is fed to the burner via a gas supply pipe, which is supplied with gas by a gas mains, a gas tank or a gas cylinder. With a town gas supply system the feed pressure is about 8 mbar; however, it is subject to fluctuations and may fall to 4 mbar. The feed pressure is about 50 mbar in the case of cooking and baking appliances operated with camping gas.

The burners have a nozzle, which forms the essential flow resistance limiting the discharged gas flow and thus determines the maximum heating power of the burner when the latter is connected to the gas supply pipe. By contrast, the flow resistance in the gas supply pipe can generally be disregarded. However, the maximum heating power of the burner must be reduced by the user to the heating power required at a given time in practice. Hence it must be possible to reduce the heating power with the aid of a suitable control element at any time, in a simple way and to a value as close as possible to the desired or required heating power.

According to the state of the art, conventional continuous control valves are used to reduce the heating power of the burner. The gas flow is throttled by partially closing the valve, and the required gas throughflow and the required heating power are thus adjusted. In most cases the valves are adjusted manually. The setting accuracy of the valves is relatively small. Furthermore, proportional valves of this type also exhibit hysteresis in the control response, so that the throughflow depends not only on the valve position or the indication on the associated adjusting knob, but also on the direction in which the valve is actuated to adjust the required throughflow (i.e. opened or closed) and the length of the preceding adjustment path.

For this reason the user is generally not guided by the scale assigned to the valve, but changes the position of the valve until the required heating power, which he can evaluate from the size of the flame or the cooking or baking of the food, is achieved. By including the user equalizing these scale deviations in the control of the heating power it can be assumed that the setting accuracy and reproducibility of the gas flow are extremely small, and the flame size and heating power may thus vary considerably with the same setting of the controller or scale.

In applications where automatic or motor-driven adjustment of the gas flow is required, it is known that stepping motors controlled by a control circuit can be used to adjust the valves. However, this solution is technically complicated and cost-intensive. The problem that the proportional valves available or used exhibit hysteresis behavior also occurs in this case, so that with control of a specific valve position by means of the stepping motor according to the control direction and control path length different gas flows result. Reproducibly assigned heating powers are thus not achieved in the respective settings even in these cases.

A measuring and testing device for single adjustment of a gas heater, in which two gas pressure controllers connected in series, a programmable control system with the operating characteristic curves required for the respective adjustment cases and four pressure measuring instruments are provided, is known from the document DE 4225789 A1. Furthermore, a number of parallel branch pipes, each of which consists of a series connection of a solenoid valve and a reference nozzle, is provided. Only one of the branch pipes is opened to adjust the gas throughput for adjustment of the gas heater; a specific gas throughput is achieved by optional connection of several nozzles in parallel only in exceptional cases. This already known device is technically very complicated, so that even though it is suitable for balancing an adjustable throttle or an adjustable gas appliance pressure controller of a gas heater as part of the production checking system, it is not suitable for the permanent adjustment of the heating power of a gas-fired cooking or baking appliance by the user.

A blower burner, in which the quantity and ratio of gas and combustion air are controlled by two continuously controllable control valves and a balance controller, is known from U.S. Pat. No. 4,585,161. A further controllable auxiliary valve is connected in parallel with the controllable control valve in the gas supply. The degrees of opening of the gas valve and auxiliary valve to achieve a constant gas throughput are controlled by a control device. Sensors for measurement of the gas throughflow rates are required for this purpose.

A controllable gas burner of a gas cooker, in which one and the same mixing pipe of the gas burner is supplied by several switchable nozzles adjacent to each other, is already known from the document CH-303445. The individual nozzles are switched on and off by a common valve, the intermediate stages being realized by throttling by cross-section reduction preceding the individual nozzles in each case.

A gas regulator with a sequence of openings with different diameters, just one of which is opened for throughflow of the gas for each required heating stage, is already known from document FR-911.892.

SUMMARY OF THE INVENTION

Taking into account this state of the art, the invention is based on the task of providing a device and a method for controlled reduction of the gas flow Q supplied to a burner nozzle of a gas-fired cooking or baking appliance via a gas supply pipe, by means of which the gas flow can be adjusted by the user of the appliance in stages reproducible with high accuracy. According to further aspects it is desirable that the method and device can be realized without technically complicated features, be easy to operate, have a long life and operate reliably.

The invention is based on the consideration that a number of throttle elements, by means of which a maximum gas flow determined by the burner nozzle and connection pressure can be reduced reproducibly step-by-step in a defined way, should be provided. Switching elements, which can switch the gas flow through the respective throttle element on and off, should be provided for connection and disconnection of the function of the respective throttle elements. A defined reduction of the gas flow can then be carried out by the combination of specific switching elements switched on and off or, if all throttle elements are open, the maximum gas flow can be achieved.

The idea according to the invention can be realized in practice in two ways, viz. by parallel connection or series connection of throttle elements.

To solve the above-mentioned problem with a method and device of the above type it is proposed according to a first feature of this invention that the gas supply pipe be branched into a number n of partial gas pipes connected in parallel, through which a partial gas flow $Q_k$ with k=1,2,3, . . . ,n can be fed to the burner nozzle, the partial gas pipes each having a control unit which is connected to the gas supply pipe on its gas inlet side and to the burner nozzle on the gas outlet side. The control units each comprise a switching element for switching the partial gas flow $Q_k$ passing through it on and off and a throttle element for reducing the partial gas flow $Q_k$ passing through it, whereby the switching elements can be switched on and off according to the selected heating power.

By splitting the gas flow into several partial gas flows, which can be switched on and off individually, according to the invention, the gas flow can be fed to the burner nozzle in graduations which correspond to the respective combinations of opened and closed switching elements. A partial gas flow is the particular gas flow which is fed to the burner nozzle through the respective partial gas pipe when its switching element is open. The total gas flow fed to the burner nozzle is obtained from the sum of the partial gas flows. In this way it is possible to realized graduations in the gas flow which can be adjusted reproducibly by switching on and off switching elements or partial gas flows.

According to another feature of the invention it is proposed in the case of a method and device of the above-mentioned type that the gas flow Q passes through a number n of control units connected in series in the gas supply pipe, each of which has a throttle element to reduce the gas flow passing through it and a switching element connected in parallel with the throttle element for switching a bypass for the throttle element on and off, and the switching elements are switched on and off according to the required heating power. Combined types, in which throttle elements are connected both in parallel and in series, are of course also possible.

The control units can basically perform the function of the switching element and that of the throttle element in an assembly, e.g. in the form of an electromagnetically operated binary throttle valve, which has a closing and a throttling position. In this case the control elements each comprise a switching element and a throttle element in the sense that they realized these elements at the same time in an individual control element.

However, it will generally be more advantageous to realized the switching elements and throttle elements as separate components in order to achieve high reproducibility of the set gas flow or a low-cost form of construction. By dividing the control units into a switching element and a separate throttle element it is possible to use particularly appropriate components depending on the suitability, costs, accuracy, reliability etc. for the respective function.

The switching elements are switched on or off individually by hand, by a respective control device or advantageously by a common control device. In the most general case a number n of control devices, with which each switching element can be switched on or off individually, should be provided. To simplify operation it is particularly advantageous, however, to provide a single common control device with different switching stages to which the corresponding gas flow graduations are assigned by combination of the partial gas flows, for the switching elements of a burner nozzle. A specific switching stage is selected by adjustment of the control device, e.g. the associated regulator, or by pressing the corresponding stage button, and the control unit combines the corresponding switching elements and partial gas flows to produce the preselected gas flow to be fed to the burner nozzle.

To provide a large number of graduations of the gas flow in the case of throttle elements connected in parallel according to the invention it is advantageous, if the flow resistances of the control units, in particular the throttle elements, are dimensioned in such a way that at least two partial gas flows $Q_k$ differ from each other. The maximum number of possible graduations can be achieved advantageously by ensuring that all flow resistances or partial gas flows $Q_k$ are different, because the largest number of differing sums of partial gas flows can be formed in this case. This maximum number of graduations is $2^n$. If all switching elements are closed, the gas flow is switched off. If all switching elements are open, the maximum gas flow $Q_{max}$ passes through. The $(2^n-2)$ further graduations lie between these two final values. As a rule in the majority of graduations, i.e. in at least $0.5\cdot 2^n=2^{n-1}$, at least with more than $0.25\cdot 2^n=2^{n-2}$ graduations more than one partial gas flow $Q_k$ will be open. Due to the throttle elements the value of $Q_{max}$ is possibly slightly smaller than the theoretical maximum value determined solely by the burner nozzle. This deviation can, if necessary, be compensated by another adapted or otherwise adjusted burner nozzle.

For practical application of the invention it is proposed according to a particularly advantageous feature that the flow resistances of the n control units be dimensioned in such a way that the n partial gas flows $Q_k$ with k=1,2,3, . . . ,n essentially form a sequence with the values $Q_k=Q_{max}\cdot 2^{k-1}/(2^n-1)$. $Q_{max}$ thus denotes the maximum gas flow Q fed to the burner nozzle when all n switching elements are open. In this way various gas flows $Q_m$, which essentially assume the values $Q_m=Q_{max}\cdot(m-1)/(2^n-1)$, can be adjusted by summation of partial gas flows m=1,2,3, . . . ,$2^n$. In this case the full control range of the gas flow from 0 to $Q_{max}$ is graduated uniformly, the interval between stages being $Q_{m+1}-Q_m=Q_{max}/(2^n-1)$. In other words the graduations of the set gas flow lie uniformly between 0 and the maximum value, with the result that particularly in the case of manual actuation of the gas control clear and simple adjustment of the heating power is possible.

The number n of the partial gas pipes is at least two. With two partial gas pipes a maximum of $2^2=4$ graduations of the gas flow can be realized. As one stage is the off position and another stage the maximum position, only two possible intermediate values remain. This may be adequate in the case of gas grill units, for example, but will usually not meet the requirements for sufficiently fine metering of the heating power in the case of gas cooking appliances.

According to a first preferred feature it is therefore proposed that the number n of the partial gas pipes be n=3, so that a total of $2^3=8$ stages with the partial gas flows, which preferably have essentially the values $Q_{max}\cdot 1/7$, $Q_{max}\cdot 2/7$ and $Q_{max}\cdot 4/7$, can be set. The relative graduations referred to $Q_{max}$ and adjustable by these partial gas flows then assume the values 0, 1/7, 2/7, 3/7, 4/7, 5/7, 6/7 and 7/7.

According to a second preferred feature it is proposed that the number n of the partial gas pipes be n=4. The partial gas flows preferably have essentially the values $Q_{max}\cdot 1/15$, $Q_{max}\cdot 2/15$, $Q_{max}\cdot 4/15$ and $Q_{max}\cdot 8/15$. The $2^4=16$ graduations adjustable with these values have the values 0, 1/15, 2/15, 3/15, 4/15, . . . , 14/15, 15/15.

With n=3 or n=4 partial gas pipes fine metering of the gas flow and control of the heating power are thus possible. The graduation can be refined by increasing the number of partial gas pipes, whereby in practical applications the achievable possibility of finer adjustment will usually not bear an acceptable relationship to the technical input. In particular in the case of burners with extremely high maximum heating power, however, an extremely fine graduation, which can be achieved simply and reproducibly with the invention over the full range, may be desirable.

It is obvious that because of production tolerances and technical inaccuracies in the components the partial gas flows $Q_k$ often do not accurately assume the graduations specified according to the above-mentioned formulae, but may deviate from them within certain tolerance ranges. In practical applications it will generally be acceptable if the maximum deviation of the partial gas flows $Q_k$ from the accurate graduation is less than ±20%, advantageously less than ±15%, preferably less than ±10% and even more preferably less than ±5%.

To enable the clearest, simplest and most reliable operation in practice in the case of both series and parallel connection of throttle elements, it is proposed that the control device for the n switching elements should have an integral number i of discrete switching positions, to each of which a combination of the open and closed positions of the n switching elements is assigned. The control device may, for example, be a rotary or step switch, a control panel with push-buttons which are assigned to the respective switching positions, or preferably also a "touch control panel", a switch which can be actuated by mere touching. In this case the user need not bother about the individual control of the different switching elements, because the control device automatically converts the selected switching stage in a predetermined way into the corresponding combination of open and closed switching elements.

It may be advantageous if the number i of the switching positions of the control device is smaller than the number of different gas flow graduations realizable with the switching elements, e.g. if not all graduations are required in practice. It may be desirable, for example, to provide a fine graduation in the simmering range, but a coarser graduation in the other ranges in order to keep the total number of adjustable stages within reasonable limits.

For simple, clear operation it is advantageous if a sequence of n=1,2,3, . . . ,i successive switching positions $S_m$ of the control device is assigned to the combinations of the open and closed positions of the n switching elements in such a way that the gas flows $Q_m$ consisting of the sum of the partial gas flows $Q_k$ in the respective switching position $S_m$ and fed to the burner nozzle form an ascending or descending sequence. In this case the next higher or lower heating stage is adjusted by increasing or reducing the switching position, i.e. a monotonous adjustment possibility is achieved.

According to a preferred feature it is proposed that the number i of the switching positions of the control device be $2^n$, whereby exactly one of the possible combinations of the open and closed positions of the n switching elements is assigned to the switching positions in each case. In this case the maximum possible number of graduations can be realised. It is particularly advantageous if the sequence of m=1,2,3, . . . ,$2^n$ successive switching positions $S_m$ of the control device is assigned to the combinations of the open and closed positions of the n switching elements in such a way that the gas flows $Q_m$ fed to the burner nozzle and consisting of the sum of the partial gas flows $Q_k$ in the case of parallel connection in the respective switching position $S_m$ form an ascending or descending sequence, which essentially assumes the values $Q_m=Q_{max}\cdot(m-1)/(2^n-1)$. Uniform graduations of the heating power are realised by the control device for successive switching positions, as is familiar to the user of electronically controllable electric cookers and electric cooking ranges. With series connection of throttle elements it will likewise be practical that the switchable gas flows $Q_m$ form an ascending or descending sequence. However, it will usually be difficult to meet the above-mentioned requirement with regard to uniform graduation of the adjustable heating powers.

For technical reasons a certain tolerance-based deviation of the set gas flow from the required value results also in this case, although it is acceptable under practical conditions. Consequently it is proposed according to a further advantageous feature that the maximum deviation of the sums $Q_m$ of the partial gas flows $Q_k$ assigned to the switching positions $S_m$ from the exact graduation should be less than ±20%, advantageously less than ±15%, preferably less than ±10% and more preferably less than ±5%.

The switching elements can basically be operated in any way, e.g. mechanically, pneumatically or hydraulically. According to a particularly preferred feature it is proposed that at least one switching element or preferably all switching elements can be operated electrically.

In an advantageous embodiment the switching elements can be binary solenoid switching valves with an open and closed position. Such solenoid switching valves are already known and meet the safety requirements. As is generally the case in electrically operated switching elements, it is advantageous according to an additional feature in such solenoid switching valves, if the clacking occurring during the switching process is prevented or dampened. For this purpose the electrical control signal can be edge-controlled at least in the switching point range during opening and/or closing of the switching element, so that the switching process does not take place abruptly. Hence an electrical circuit is advantageously provided for gradual increase and/or reduction of the electric control current.

To achieve long life and operational reliability of the device according to the invention it is an advantage that the switching elements perform only a few switching cycles, viz. only if the setting of the gas flow Q is changed. Hence they are subject only to long-term wear, if at all.

In more elaborate forms of construction the flow resistance of the throttle elements can be adjusted at the works or, if necessary, by the user. Adjustable throttle valves with a calibration facility for setting and adjustment of their throttle resistance to a required value, for example, come into consideration for this purpose. This may be advantageous if it is important to achieve high accuracy of the graduations or the set partial gas flows, which is realizable by accurate setting and adjustment of the throttle elements. According to a preferred feature adequate for the usual accuracy requirements in practice, it is proposed that one, several or preferably all throttle elements should have a fixed flow resistance. The throttle elements can be realized, for example, as a capillary, capillary tube, nozzle or pipe narrowing. These forms of construction can be realized with satisfactory accuracy and at low cost.

The advantages of a device and a method according to this invention compared to the state of the art are that a required, graduated reduction of the gas throughflow of a burner nozzle can be realized with high reproducibility by means of already known and commercially available components, so that the same heating power is reliably achieved with the respective setting of the assigned control device. The actuation of the device by control elements can be performed by an inexpensive control device using commercially available components. A further advantage is that the invention can also be constructed exclusively with binary switching elements, i.e. without proportional valves.

It should be noted that pressure fluctuations in the gas supply pipe are not compensated by the invention and consequently also affect the heating power. The invention does not solve the problem of realizing reproducible gas flows and heating powers when considered in absolute terms, but solves the problem of graduating a predetermined maximum gas flow to smaller values in a reproducible manner. If the maximum gas flow changes due to fluctuations in the mains system pressure, the reduced graduated gas flows will also change accordingly. However, the reproducibility of the setting is maintained. Considering that fluctuations in the mains system pressure have only a small effect on the heating power, take place only gradually and the resulting changes in the heating power are taken into account also in the conventionally used valves, the invention is a considerable improvement compared to the state of the art for reproducible controlled reduction of the gas flow. If required, the device according to the invention can also be combined with a device which compensates for or reduces fluctuations in the gas pressure in the gas supply pipe.

The following exemplified embodiments of the invention reveal further advantageous features, which are described and explained in more detail below with reference to the schematic representations in the drawings.

BRIEF DESCRIPTION OF THE DRAWINGS

FIG. 2 shows a switching matrix of a control device for FIG. 1, FIG. 3 shows a switching matrix of a control device with 10 switching positions, FIG. 4 shows a switching matrix of a control device for FIG. 1A with 14 switching positions and FIG. 5 shows a schematic representation of a device according to the invention with three throttle elements with a bypass connected in series.

DETAILED DESCRIPTION OF THE INVENTION

Figure 1:
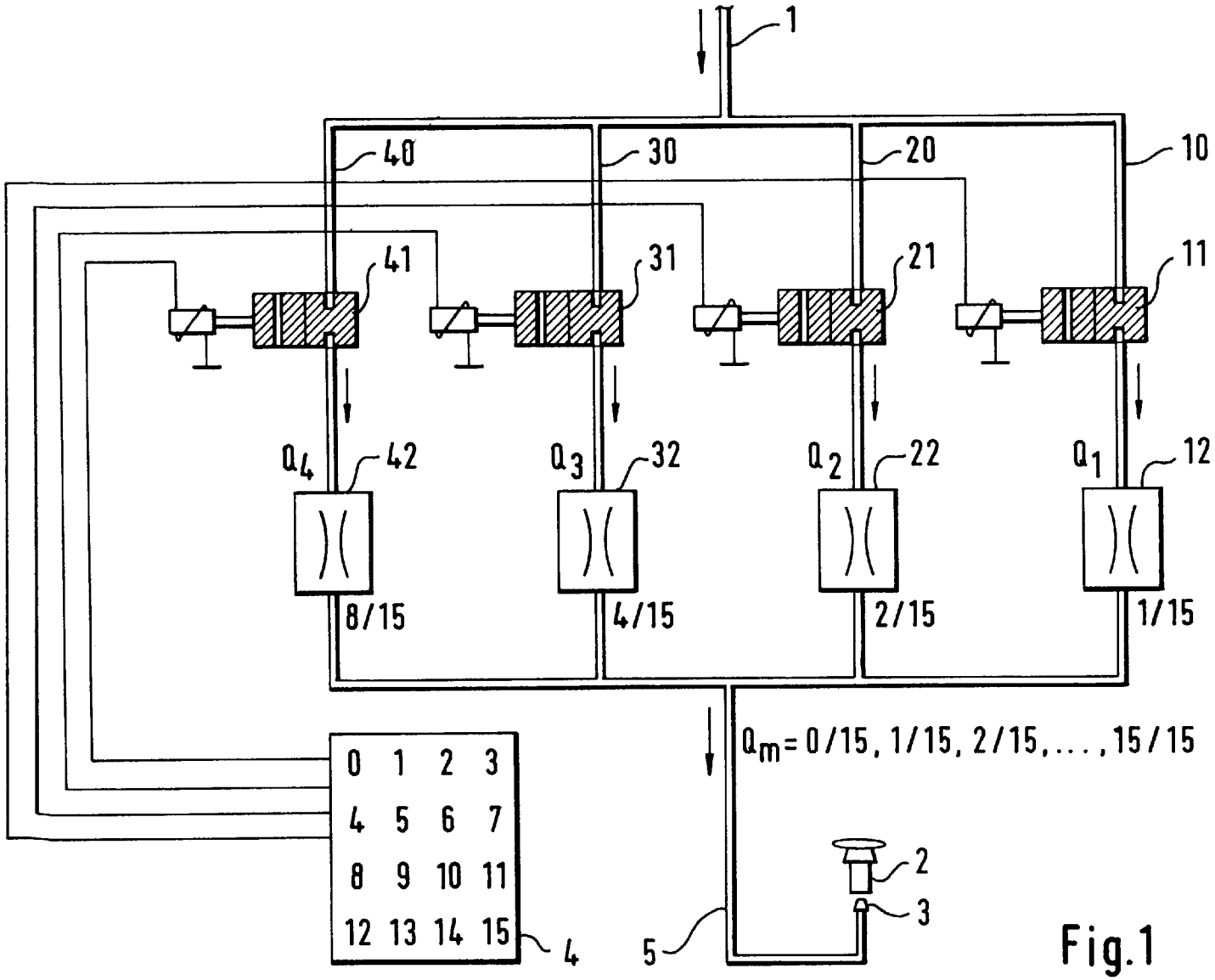
FIG. 1 shows a schematic representation of a device according to the invention with four partial gas pipes.

FIG. 1 shows a gas supply pipe 1 supplied by a gas main, a gas tank or a gas cylinder for the controlled supply of gas according to the invention to a burner nozzle 3, which is the integral part of a burner 2, which can be installed e.g. in a gas cooker or gas baking oven. The safety elements (thermocouple and associated solenoid valve) usual for gas cooking and baking appliances, which interrupt the gas flow when the flame is extinguished, are not shown.

The gas supply pipe 1 branches into four partial gas pipes 10, 20, 30, 40 connected in parallel, which subsequently recombine to form a burner supply pipe 5 connected to the burner nozzle 3. The partial gas pipes 10, 20, 30, 40 each have a control unit for control of the partial gas flows $Q_1$, $Q_2$, $Q_3$, $Q_4$. The control units each comprise a switching element 11, 21, 31, 41 and a throttle element 12, 22, 32, 42. In the preferred embodiment described all four switching elements are electrically operated binary solenoid switching valves, which have an open and closed position, so that a partial gas flow $Q_k$ can be switched on or off. The opening and closing of the solenoid switching valves 11, 21, 31, 41 independently of each other is controlled by a control device 4.

The throttle elements 12, 22, 32, 42 are capillaries, which have a fixed flow resistance and serve to reduce the respective partial gas flow $Q_k$ to a fraction of the maximum gas flow $Q_{max}$ supplied. The capillary 12 throttles the partial gas flow $Q_1$, for example, in such a way that it amounts to only 1/15 of the maximum gas flow when the solenoid switching valve 11 is opened. As a result of the smaller flow resistance of the capillary 22 the partial gas flow $Q_2$ is reduced to 2/15 of the maximum gas flow when the solenoid switching valve 21 is open. By contrast the capillaries 32 or 42 reduce the partial gas flows $Q_3$ or $Q_4$ only to 4/15 or 8/15 of the maximum gas flow when the solenoid switching valve 32 or 42 is open.

The capillaries 12, 22, 32, 42 are connected behind the respective solenoid switching valves 11, 21, 31, 41 in the direction of flow of the gas. Firstly, this arrangement has safety advantages, because in comparison with a converse arrangement in the closed position of a solenoid switching valve 11, 21, 31 or 41 fewer components are under gas pressure. Secondly, it is advantageous that the time elapsing until the full partial gas flow is achieved when a solenoid switching valve 11, 21, 31 or 41 is opened is shorter than with the converse arrangement.

The gas flow $Q_m$ supplied to the burner nozzle 3 is obtained from the sum of the partial gas flows $Q_1$ to $Q_4$ switched on. If only the solenoid switching valves 11 and 31 are opened, for example, the gas flow $Q_m$ fed to the burner nozzle 3 consists only of the partial gas flows $Q_1$ and $Q_3$.

In the exemplified embodiment shown the flow resistances of the capillaries 12, 22, 32, 42 with 1/15, 2/15, 4/15 and 8/15 are dimensioned in such a way according to the general formula $Q_k=Q_{max}\cdot 2^{k-1}/(2^n-1)$ that 16 different gas flows $Q_m$ can be fed to the burner nozzle 3. This corresponds to the maximum number of graduations ($2^n$) achievable with four partial gas flows $Q_k$, the full range of the gas flow from 0 to $Q_{max}$ being graduated uniformly in this case. Each stage amounts to 1/15 of the maximum gas flow $Q_{max}$.

To make operation of the burner 2 by the user as simple, clear and safe as possible, the control unit 4, which coordinates the opening and closing of the solenoid switching valves 11, 21, 31, 41 during regulation of the gas flow and thus of the heating power, has 16 switching positions $S_m$. Exactly one of the possible combinations of the open and closed positions of the four solenoid switching valves 11, 21, 31, 41 corresponds to each of these switching positions. In the example shown the control unit is a "touch control panel", its 16 switches, which can be operated merely by touching, each being assigned to one of the combinations. In this way it is possible for the control device 4 to convert the switching position selected by the user independently in a predetermined way into the appropriate combination of open and closed solenoid valves 11, 21, 31, 41 and thus to produce the required gas flow $Q_m$ fed to the burner nozzle 3.

The mode of operation of the control device 4 shown in FIG. 1 with 16 switching positions $S_m$ for the control of four different partial gas flows $Q_1$ to $Q_4$ with the values $Q_{max}\cdot 1/15$, $Q_{max}\cdot 2/15$, $Q_{max}\cdot 4/15$ and $Q_{max}\cdot 8/15$ is explained in more detail with the aid of a switching matrix in FIG. 2. In the switching matrix a corresponding combination of open and closed valves 11, 21, 31, 41 is assigned to the 16 maximum possible switching positions $S_m$ of the control device 4, which correspond in each case to a stage of the gas flow $Q_m$ graduated uniformly between 0 and $Q_{max}$. In the matrix 0 denotes that the corresponding solenoid valve 11, 21, 31, 41 is closed, i.e. the partial gas flow $Q_1$, $Q_2$, $Q_3$, $Q_4$ is switched off. At 1 the solenoid switching valve 11, 21, 31, 41 is open and the partial gas flow $Q_1$, $Q_2$, $Q_3$, $Q_4$ is switched on.

If, for example, the user actuates the switch 6 of the touch control panel 4 shown in FIG. 1, he selects the switching position $S_7$, which corresponds to a gas flow $Q_6$ of 6/15 of the maximum gas flow $Q_{max}$. This switching stage is realized by the control unit 4 by opening the solenoid switching valves 21 and 31 and closing the solenoid switching valves 11 and 41, so that the gas flow $Q_6$ fed to the burner nozzle 3 consists of the sum of the partial gas flows $Q_2$ and $Q_3$.

According to the invention it is not always necessary, however, for all partial gas flows to be different. In particular, if it is unnecessary to realized the maximum possible number of graduations with the respective number of partial gas flows, individual partial gas flows can be dimensioned identically. This has the advantage, for example, that the number of different components to be stocked is reduced.

Conventional gas-fired cooking and baking appliances usually have nine cooking stages (a total of ten switching stages). According to the invention this number of cooking stages can be realized, for example, by the following four partial gas flows referred in each case to $Q_{max}$: 1/9, 1/9, 2/9, 5/9. Other possibilities are the partial gas flows 1/9, 2/9, 2/9, 4/9 or 1/9, 1/9, 3/9, 4/9.

FIG. 3 shows as an example a switching matrix of a control device 4 for an embodiment according to an invention with four partial gas flows $Q_1$ to $Q_4$, in which two partial gas flows are identical (1/9, 1/9, 2/9, 5/9). The switching matrix again converts the switching position $S_m$ selected by the user via a combination of open (1) and closed (0) solenoid switching valves 11, 21, 31, 41 into a gas flow $Q_m$ obtained from the sum of the respective partial gas flows $Q_k$, which corresponds to the switching position and is fed to the burner nozzle 3. The usual number of nine cooking stages in conventional gas-fired cooking and baking appliances can be realized advantageously in this way.

Figure 1A:
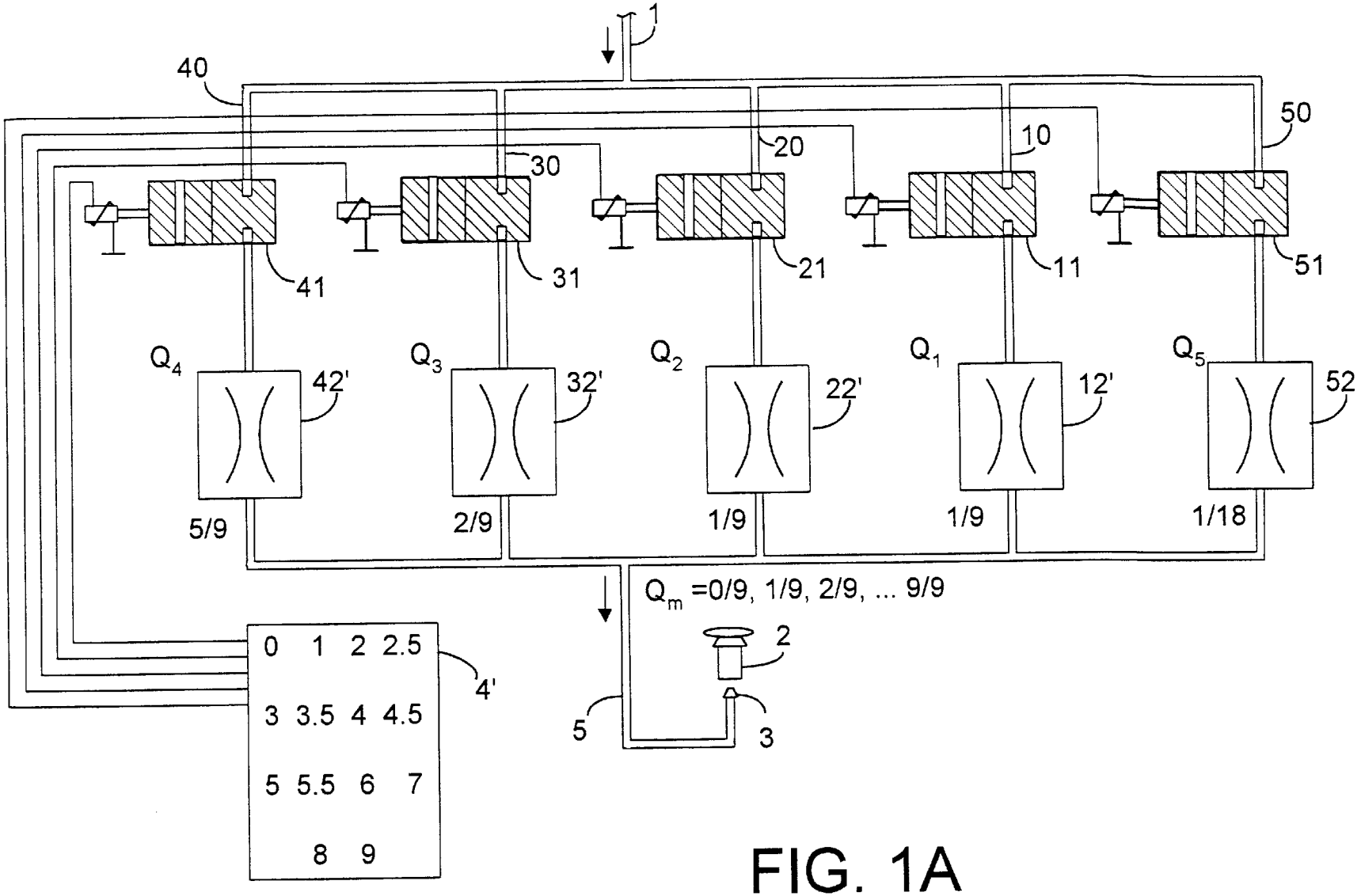
FIG. 1A shows a schematic representation of another device according to the invention with five partial gas pipes.

It may also be advantageous for the gas flow $Q_m$ fed to the burner nozzle 3 to be regulated more finely in the cooking range (which is generally at stage four in the case of nine cooking stages) by means of intermediate stages in order to adjust the heating power with finer metering in this range. To improve the embodiment according to the invention for nine cooking stages described in FIG. 3 from this point of view, a fifth solenoid switching valve 51 in pipe 50 can additionally be provided with the associated throttled fifth partial gas flow $(1/2)\cdot(1/9)=1/18=(0.5)/9$ of throttle 52 as shown in FIG. 1A. FIG. 4 shows a switching matrix of a control device 4 for such an embodiment according to the invention. It can be seen that the combinations of the open and closed positions of the solenoid switching valves 11, 21, 31, 41 correspond to those of the respective solenoid switching valves in FIG. 3 for throttle elements 12', 22', 32', 42'. Intermediate cooking stages 2.5/3.5/4.5/5.5, which are realized by additional connection of a partial gas flow $Q_5$ with the value (0.5)/9 via the solenoid switching valve 51 by the control unit 4 for the combination of open and closed solenoid switching valves known from FIG. 3, can be selected by the user only in the cooking range between 2/9 and 6/9 of the maximum gas flow $Q_{max}$ corresponding to the cooking stages 2–6.

It should be noted that with this embodiment the calculated maximum sum of the partial gas flows is (9.5)/9, i.e. greater than $Q_{max}$, if all solenoid switching valves 11, 21, 31, 41, 51 are open. The gas flow $Q_{max}$ actually prevailing when all solenoid switching valves are opened will, of course, not be greater than the maximum gas flow $Q_{max}$ predetermined by the flow resistance of the burner nozzle 3, because the device according to the invention reduces the gas flow in a definite manner, but does not increase the gas flow.

Figure 5:
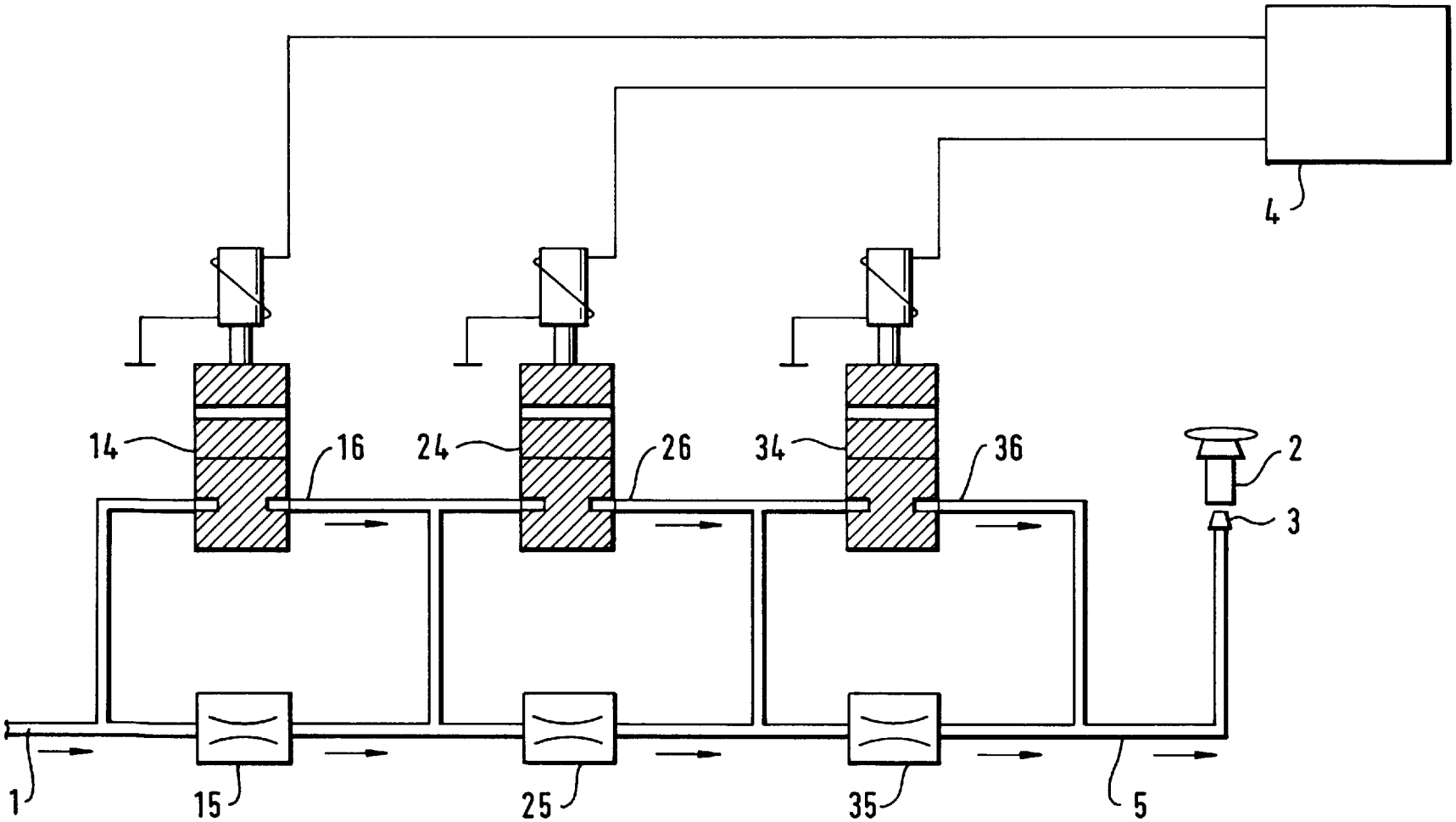

In the embodiment according to FIG. 5 three throttle elements 15, 25 and 35 are connected in series in the gas supply pipe 1. The throttle resistances of the individual throttle elements are preferably different. They may be dimensioned, for example, in such a way that the gas flow fed to the burner nozzle 3 of the burner 2 via the burner supply pipe 5 is reduced to 3/4 or 1/2 or 1/4 by switching on a throttle element in each case. When two or three throttle elements are switched on, the gas flow is reduced to a fraction of the maximum gas flow determined by the product of the above-mentioned proportions.

Switching elements 14, 24 and 34 are connected in parallel with the respective throttle elements in order to switch them on and off. When a switching element is opened the gas flow passes unhindered through the switching element acting as a bypass 16, 26, 36, so that the associated throttle element does not reduce the gas flow. For example, the reduction by the throttle element 25 is out of operation when the switching element 24 is opened and the gas flow is reduced only by the throttle elements 15 and 35, insofar as the throttle elements 14 and 34 are closed.

The switching elements 14, 24 and 34 are controlled by a common control device 4", which can be used to set the required heating power. An additional switching valve (not shown) installed in the burner supply pipe 5 or preferably the gas supply pipe 1 is required for disconnection of the gas flow. The solenoid valve for monitoring the extinction of the flame, for example, can be used for this purpose.

We claim:

1. A device for a controlled stepwise reduction of a gas flow Q fed to a burner nozzle of a gas-fired cooking or baking appliance via a gas supply pipe, comprising a plurality n of control units connected in series in the gas supply pipe and wherein the control units each comprise a throttle element for reduction of gas flow passing through it and a switching element connected in parallel with the throttle element for switching on and off a bypass for the throttle element, and wherein the switching elements are switched on and off according to a selected heating power.

2. The device according to claim 1, wherein the switching elements are switched on and off by a common control device.

3. The device according to claim 2, wherein the control device has an integral number i of discrete switching positions, to which a combination of the open and closed positions of the n switching elements is assigned in each case.

4. The device according to claim 3, wherein the number i of switching positions of the control devices is $2^n$, exactly one of the possible combinations of the open and closed positions of the n switching elements being assigned to the switching positions in each case.

5. The device according to claim 4, wherein the combinations of the open and closed positions of the n switching elements are assigned to a sequence of m=1,2,3, . . . ,$2^n$ successive switching positions $S_m$ of the control device in such a way that the gas flows $Q_m$ fed to the burner nozzle form an ascending or descending sequence, which assumes essentially the values $Q_m=Q_{max}\cdot(m-1)/(2^n-1)$.

6. The device according to claim 5, wherein a maximum deviation of the gas flows $Q_m$ from the exact graduation is less than ±20%, advantageously less than ±15%, preferably less than ±10% and more preferably less than ±5%.

7. The device according to claim 1, wherein at least one switching element is a binary solenoid switching valve.

8. The device according to claim 1, further comprising an electrical circuit for a gradual increase and/or reduction of an electric control current of the switching element.

9. The device according to claim 1, wherein at least one of the throttle elements has a fixed flow resistance.

10. The device according to claim 9, wherein the throttle element is one of a capillary, capillary tube, nozzle or pipe narrowing.

11. A cooking or baking appliance, in particular a gas cooker, gas cooking range or gas baking oven, comprising a device according to claim 1.

12. A method for a controlled stepwise reduction of a gas flow Q fed to a burner nozzle of a gas-fired cooking or baking appliance via a gas supply pipe, comprising the steps of passing the gas flow Q through a plurality n of control units connected in series in the gas supply pipe, which in each case have a throttle element for reduction of the gas flow passing through and a switching element connected in parallel with the throttle element for connection and disconnection of a bypass for the throttle element, and switching the switching elements on and off according to a selected heating power.

13. The method according to claim 12, wherein the n switching elements are switched on and off by a common control device.

14. The method according to claim 12, wherein the n switching elements are controlled by a control device, which has an integral number i of discrete switching positions, each of which is assigned to a combination of the open and closed positions of the n switching elements.

* * * * *